United States Patent [19]

Hamilton et al.

[11] 3,964,651

[45] June 22, 1976

[54] TAMPER-PROOF GARMENT HANGER

[76] Inventors: Rose B. Hamilton, 95 Brookfield St., Manchester, Conn. 06040; Joan R. Yarus, 37 Beals St., Brookline, Mass. 02146

[22] Filed: Oct. 23, 1974

[21] Appl. No.: 517,159

[52] U.S. Cl. ..... 223/91

[51] Int. Cl.[2] ..... A47J 51/14

[58] Field of Search ..... 223/90, 91, 96; 211/113

[56] References Cited

UNITED STATES PATENTS

| | | | |
|---|---|---|---|
| 2,588,235 | 3/1952 | Herrick | 223/90 |
| 2,765,967 | 10/1956 | Boyagain | 223/91 |

*Primary Examiner*—George H. Krizmanich

*Attorney, Agent, or Firm*—Marden S. Gordon

[57] ABSTRACT

A hanger designed to frustrate potential shoplifters by clamping a portion of the garment suspended thereon to the hanger and requiring a series of unlocking movements to free the garment therefrom, the hanger consisting of a customary inverted V-shaped yoke having hollow arm members converging together at the top to be secured to a suspension hook, the suspension hook being associated with rigid locking rods extending through the hollow arms and terminating adjacent the shoulder portions of the yoke for cooperation with a clamping linkage and which locks the clamping linkage in a closed clamping position when the suspension hook lies in the plane of the yoke, rotation of the hook 90° unlocking the clamping mechanism to permit opening thereof to release a garment from the hanger.

4 Claims, 7 Drawing Figures

16
15
13
14
10
38
12
28
30
25
22
11
21
24
23
17
18

16
30
15
13
26
25
10
38
11
28
27
21
23
24
17

16
41
15
44
14
45
42

48
31
47
45
38
34
36
32
33
37
35
22
21
26
30
27
11
28
14
36
22
21
35
37
45

29
28
26
27'
27

46
49
48
47
45
43
42
16
11

49
46
48
47
31
45
43
11
42
16

TAMPER-PROOF GARMENT HANGER

BACKGROUND OF THE INVENTION

1. Field of the Invention

This invention relates generally to garment hangers and more particularly to a novel and improved garment hanger of a tamper-proof operation to frustrate shoplifters by releasably locking the garment to the hanger while yet permitting easy removal of the garment from the hanger when desired.

2. Description of the Prior Art

As is well known in the sale and display of garments, such garments are displayed for inspection and general display and advertising purposes on hangers where the garments are easily removed therefrom by shoplifters or potential shoplifters, this resulting in losses to the commercial business. Presently there are few, if any, mechanical provisions made in commercial stores selling and displaying garments to frustrate and hamper the efforts of shoplifters.

Prior art devices are known which attach a chain or other connection between the hanger or the hanger pole or other fixed member and to the garment to prevent unauthorized removal of the garment therefrom, but such devices frequently damage the garments, requiring time consuming and laborious efforts to remove the device from the garment should the garment wish to be tried on by a prospective purchaser, and otherwise are frustrating in use such that the devices soon fall into nonuse by sales personnel who would rather chance having the garments stolen than continuously attach and detach the anti-theft chain or device to the garment.

SUMMARY OF THE INVENTION

The present invention provides a novel tamper-proof garment hanger for the hanging of garments thereon and which frustrates the efforts of shoplifters as the hanger includes means thereon for clamping and locking the garment on the hanger so that it is a difficult matter for an unauthorized individual to resort to shoplifting tricks and to steal the garment as the locking means require a series of steps which, while easily and rapidly performed, cannot be performed inconspicuously.

It is a feature of the present invention to provide an improved tamper-proof garment hanger.

A further feature of the present invention provides a garment hanger including clamps for releasably securing the garment in position on the hanger.

Still a further feature of the present invention provides a garment hanger which is relatively inexpensive to manufacture due to its simplicity of construction such that it may be produced and retailed at a sufficiently low price to encourage widespread use thereof.

Still yet a further feature of the present invention provides a garment hanger which is easy to use and reliable and efficient in operation in a manner requiring positive action by sales personnel to automatically return the hanger to a locked position before returning the hanger to the pole on which it is suspended.

Other features and advantages of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
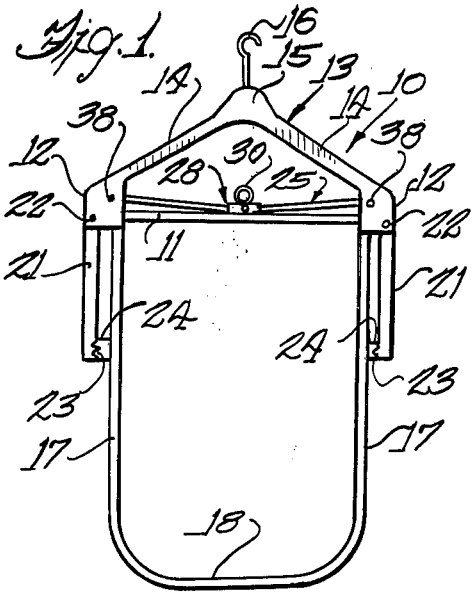
FIG. 1 is a front elevational view of the garment hanger of the invention in the locked position.
Figure 2:
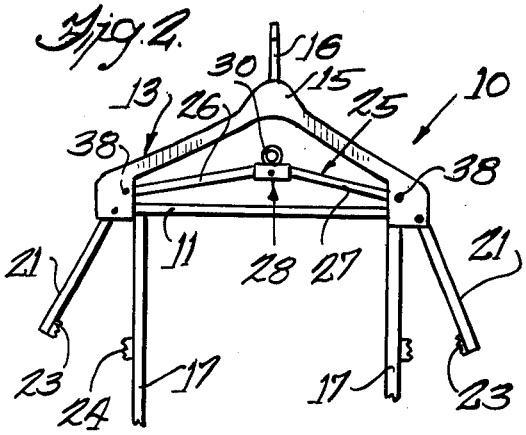
FIG. 2 is a front elevational view of the garment hanger in the unlocked position.

Referring now to the drawings in detail there is illustrated a preferred form of a tamper-proof garment hanger constructed in accordance with the principles of the present invention and designated generally in its entirety by the reference numeral 10 and which embodies in its construction a horizontal rigid cross member 11 which extends between the shoulder portions 12 of the customary inverted V-shaped yoke or top portion 13 having hollow leg members 14 joined together at top ends 15 and equipped with a suspension hook 16 extending vertically outwardly therefrom and rotatable relative thereto about its axis. A pair of side members 17 extend downwardly from each of the shoulder portions 12 and are connected together at their lower ends by a transverse cross-member 18.

A pair of clamps 21 are pivotally attached by pivot pins 22 to associated shoulder portions 12 and are provided at their lower terminal ends with clamping pads 23 which are engagable with similar type pads 24 secured to associated ones of the side members 17.

The clamps are pivotable about the pivot pins 22 within the plane defined by the side members 17 and are operable interconnected by an articulated toggle bar 25 which consists of a pair of rigid links 26 and 27 having their adjacent ends pivotally connected together by pivot pin 27', the pivot pin extending normal to the plane of side members 17 and diametrically of a hollow open ended sleeve 28 having side walls 29 with the pin passing through the side walls to be affixed thereto. A ring 30 is affixed to side walls 28 on the top central portion thereof and is used for operation of the toggle bar as will be later described.

Each of the links 26 and 27 are of an identical structure formed of flat stock material and extending outwardly from pivot pin 27' terminating inwardly of the associated shoulder portion 12 with a flat vertically downwardly extending edge 31 which then merges into a terminal end portion 32 extending downwardly and outwardly therefrom. Pivotally interconnecting the end 33 of terminal end portion 32 and the topmost end 34 of clamps 21 is a linkage element 35 connected therebetween by pivot pins 36 and 37 as shown. A pivot pin 38 extends through the links 26 and 27 at the terminal end of vertical edge 31 at the juncture point with end portion 32, the pivot pins 38 extending normal to the plane of the side members 17 and pivotally connecting the links to the associated shoulder portions 12 for pivotal movement relative thereto.

The link members 26 and 27 extend inwardly and downwardly relative to pivot point 38 to be joined at the pivot 27', this joining being an over-center position when sleeve 28 engages cross-member 11, this position effecting pivotal movement of clamp arms 21 to engage pads 23 with pads 24 such that a garment affixed to the hanger, such as a men's suit coat having clamp arms 21 extending through a portion of the sleeves thereof, is securely maintained in position on the hanger with portions of the coat sleeves being clamped between pads 23 and 24. Pulling upward on ring 30 to an over-center position spaced from cross-member 11 effects the outward pivotal movement of arms 21 relative to sides 17 to thus permit any garment to be free from the hanger.

In this regard it is to be noted that the over dead center positions are relative to the straight line defined between the horizontal position of link members 26 and 27 when axially aligned.

The suspension hook 16 extends outwardly of the top 15 of the yoke 13 and includes a shank 41 extending axially through the yoke top portion and rotatably mounted thereto for rotation about its axis. Affixed to a terminal end portion of the shank 41 inwardly of top 15 and extending horizontally is a circular flat disc shaped plate 42 having a pair of diametrically opposed openings 43 extending therethrough adjacent the peripheral edges thereof. Each opening 43 has rotatably affixed thereto an associated end 44 of an elongated rigid control rod 45 extending axially through hollow leg members 14 and terminating at its opposite end 45 being rotatably received in an aperture 46 disposed in a radially spaced position from the central axis of a horizontal flat circular control disc 47 mounted in each of the shoulder portions 12. Each disc 47 is rotatably mounted in a horizontal plane about its central axis by shaft 48. A V-shaped notch 49 is provided in the peripheral edge of each of discs 47 circumferally spaced from opening 46 and having its vertex pointing radially inwardly of the disc toward shaft 48.

Figure 3:
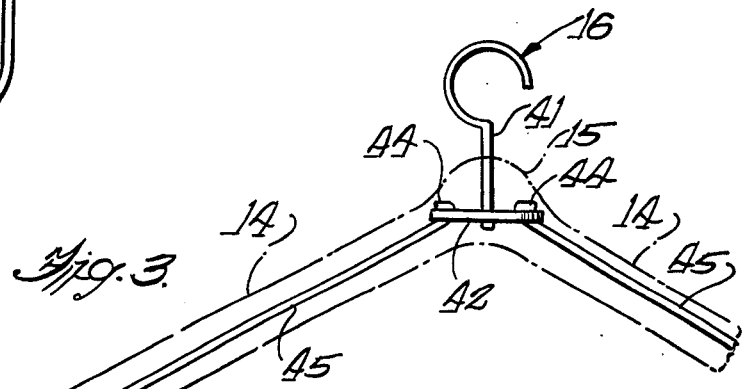
FIG. 3 is an enlarged fragmentary front elevational view of the locking mechanism of the garment hanger in the locked position.
Figure 5:
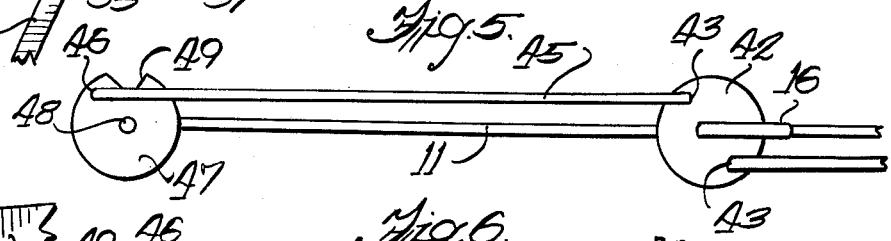
FIG. 5 is a top plan view of a portion of the locking mechanism in the locked position.

The discs 47 are in horizontal alignment with their peripheral edges disposed in immediate adjacentcy to vertical straight edge 31 of each of their associated links 26 and 27 respectively when the links are in the locking position with sleeve 28 adjacent cross member 11 and pads 23 and 24 in engagement. In this position, as clearly seen in FIG. 3, it is apparent that the links 26 and 27 are locked and cannot be raised by ring 30 as straight edge 31 strikes the peripheral adjacent edge of disc 47, this thus being the closed locked position of the garment hanger as illustrated in FIGS. 3 and 5.

Figure 4:
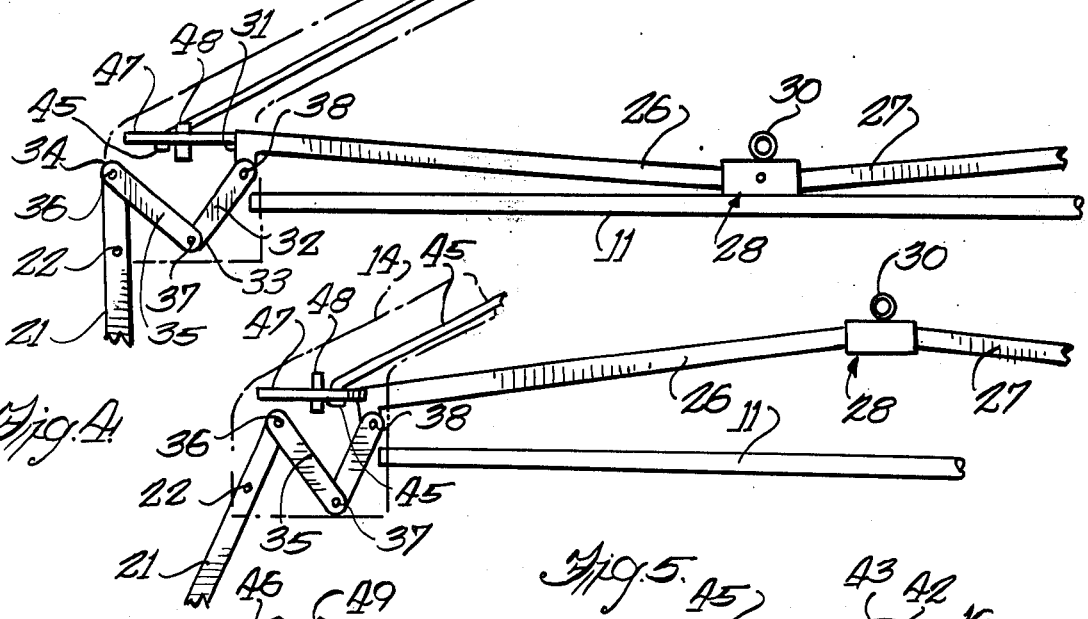
FIG. 4 is a fragmentary front elevational view of a portion of the locking mechanism in the open position.
Figure 7:
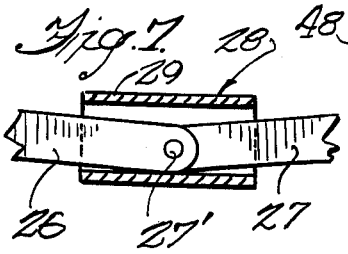
FIG. 7 is a fragmentary front elevational view partially in cross-section taken at the central sleeve.
Figure 6:
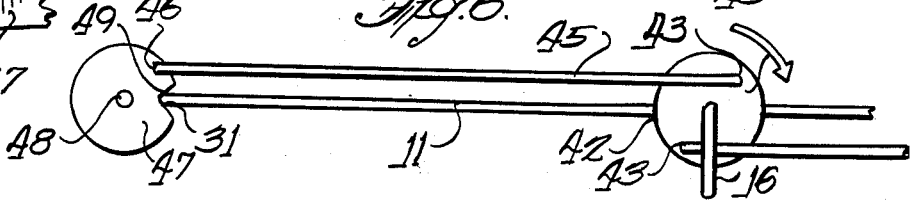
FIG. 6 is a top plan view similar to FIG. 5 but with the same portion of the locking mechanism illustrated in the open position.

To unlock the hanger to permit a garment to be removed therefrom, suspension hook 16 is rotated about its axis through an angle of ninety degrees, this effecting rotation of plate 42 which, in turn, effects similar rotation of interconnected control discs 47 to place the notches 49 of each of the control discs in alignment with associated links 26 and 27 such that the space of the notch is disposed adjacent vertical straight edge 31. This position of the discs is as illustrated in FIG. 6. It is now apparent that grasping ring 30 and lifting sleeve 28 will move the links 26 and 27 to the position of FIG. 4 with straight edge 31 fitting into notch 49 to permit such movement of the links, this effecting the opening of clamps 21 to separate pads 23 and 24 to permit the removal of a garment therefrom.

It is thus apparent that after a garment has been clampingly secured to the hanger 10, that to remove the garment an individual must first remove the hanger from a supporting rod, then rotate the suspension hook through a 90° angle, and then lift up on ring 30 to operate links 26 and 27 to free pads 23 and 24 from each other. Only then may the garment be removed. Similarly, for the garment to be returned to the hanger, this is accomplished in a fast and easy manner as the garment is placed on the hanger in the normal manner with clamps 21 extending through the sleeves of the coat portion of the garment, sleeve 28 is depressed to engage cross member 11 to effect the clamping of the garment in position, after which suspension hook 16 is rotated through a 90° angle to effect locking of the links by the control discs 47.

In addition, it is to be noted that the side frames 17 and cross member 18 make up a general U-shaped extension frame which is co-planar with the yoke 13 and cross-member 11, the extension frame being rigid and relatively long, as least as long as the overall length of the cross-member 11. Thus, any ordinary or conventional garments displayed in the stores may be hung on the garment hanger. Thus, the yoke 13 will take care of the coat to a suit with the cross-member 11 providing suspension for suite trousers, the extended U-shaped extension frame not inerfering with the usual placement of the garment on the hanger. However, the clamping means when closed will grip the juntional portions of the coat sleeves and the body of the coat, for instance, in a manner to substantially lock the coat and hanger together. Considering the difficulty which attends tampering with this garment and hanger combination, it is plain to be seen that shoplifting activities will be reduced to a minimum, perhaps, eventually taken care of, insofar as garments suspended on hangers are concerned.

In addition, the extended U-shaped extension frame makes the hanger cumbersome and sufficiently unwieldy to protect against the bundling of the garment around the coat hanger, as is often done for compactness by shoplifters, this making it difficult for shoplifters while making it easier for store detectives and others to spot shoplifters.

It is to be understood that the form of this invention herewith shown and described is to be taken as a preferred example of the same, and that this invention is not to be limited to the exact arrangement of parts shown in the accompanying drawings or described in this specification as various changes in the details of construction as to shape, size, and arrangement of parts may be resorted to without departing from the spirit of the invention, the scope of the novel concepts thereof, or the scope of the sub-joined claims.

Having thus described the invention, what is claimed is:

1. A tamper-proof garment hanger comprising:

an inverted V-shaped yoke of hollow construction formed of a pair of hollow converging leg members with a top member defined at the converging ends thereof and with shoulder portions defined at the spaced apart ends thereof;

a rigid horizontal cross-member extending in the plane of the yoke and interconnecting the shoulder portions;

a suspension hook having a curved hook portion and a shank extending vertically into the top member, the shank being rotatably affixed to the top member for rotation of the hook relative thereto about its axis;

vertically extending depending side members affixed to each shoulder portion and extending downwardly therefrom parallel to each other;

a pair of elongated rigid clamp arms each associated with one of the shoulder portions and pivotally attached thereto intermediate its ends and spaced outwardly from respective ones of the side members, the clamp arms being pivotably movable in the plane of the side members, the clamp arms each having a top end and a bottom end;

a pad affixed to the bottom end of each of the clamp arms extending outwardly therefrom in the direction of the associated side member;

a pad affixed to each side member in a position thereon to be engaged by an associated pad of the associated clamp arm;

a toggle mechanism consisting of a pair of complemental identical link elements each of a generally L-shaped configuration and having the outer ends of their long leg portions pivotally connected together at a point intermediate the ends of the cross-member, the terminal end of the short leg portion extending vertically downwardly from the long legs inwardly of an associated shoulder portion and being pivotally attached to the shoulder portion for guiding the pivotal movement of the toggle between a first position adjacent the cross-member and a second position spaced from the cross-member;

a connecting member formed integrally with the short leg portion of each of the link elements and extending downwardly and outwardly at an angle thereto from the point of pivot connection to a point adjacent the lower edge of the associated shoulder portion;

a connecting link member having one end pivotally connected to the terminal end of the short leg portion extension and having its opposite end pivotally connected to the top end of the associated clamp arm;

movement of the pivot joint interconnecting the adjacent ends of the link elements to a position adjacent the cross-member effecting pivotal movement of the clamp arms in a direction to engage the terminal ends thereof with the pads of the side members, and movement of the toggle to the second position spaced upwardly and away from the cross-member effecting the outward pivotal movement of the terminal ends of the link members away from the side members, these positions being referred to as the clamping positions and the unclamping positions respectively; and locking means associated with each of the link elements when in the clamping position to prevent unauthorized movement of the toggle to the unclamping position, the locking means being operable to an unlocking position to permit free movement of the toggle between the clamping and unclamping positions.

2. The garment hanger as set forth in claim 1 further comprising a hollow cylindrical open ended sleeve extending over the adjacent pivotally connected ends of the link members, the pivotal connection between the link members extending diametrically through the side walls of the sleeve to retain the sleeve affixed about the ends of the link members; and a ring affixed to the top exterior surface of the sleeve adapted to be grasped between the fingers of an individual's hand to move the sleeve between the clamping position adjacent the cross-member and the unclamping position spaced upwardly away from the cross-member.

3. The garment hanger as set forth in claim 2 further characterized by the locking means comprising:

a flat circular disc-shaped plate horizontally disposed in the yoke top member and affixed concentrically to the terminal end portion of the suspension hook shaft for simultaneous rotation therewith;

a pair of spaced apart openings disposed in the plate spaced apart from each other;

a pair of flat horizontally disposed circular control discs each rotatably mounted about its axis in an associated one of the shoulder portions of the yoke with its peripheral edge in close abutting relationship to the terminal edge of the corner of the associated link member as defined where the exterior edge of the long leg portion joins with the exterior edge of the short leg portion;

an opening extending through each disc adjacent the peripheral edge thereof;

a notch disposed in each disc circumferally spaced from the opening and extending through the peripheral edge of the disc;

a pair of elongated rigid control rods, each rod extending through one of the hollow leg members of the yoke and having one end thereof connected through one of the openings of the plate with the opposite end thereof extending to an associated control disc and rotatably connected to the opening therein;

the hook forming portion of the suspension hook being normally co-planar with the yoke and rotatable through an angle of about ninety degrees to a position normal to the plane of the yoke;

the hook portion when co-planar with the yoke positioning the plate and control discs to provide a peripheral edge of the control discs in abutting relationship with associated portions of the link members when the toggle is in the clamping position to prevent movement of the toggle to the unclamping position;

rotation of the hook to the position normal to the plane of the yoke effecting simultaneous rotation of the plate which, through operation of the control rods, effects simultaneous rotation of the control discs to move the notches thereof into alignment with the associated portions of the link members to provide freedom of movement of the link members through the notch to thus permit the toggle to be moved to the unclamping position.

4. The garment hanger as set forth in claim 3 wherein the side members extend a substantial distance downwardly from the shoulder portion, a transversely extending member interconnects the bottom ends of the side members to define a generally U-shaped extension frame co-planar with the yoke and cross-member, the U-shaped frame being of appreciable length constituting a guard which, in conjunction with the triangular frame configuration of the yoke and cross member renders the overall hanger cumbersome, prevents the garment on the hanger from being bundled into a compact package and otherwise hinders and thus forestalls theft, that is, getting away with the garment and hanger.

* * * * *